US009370779B2

(12) United States Patent
Haarla et al.

(10) Patent No.: US 9,370,779 B2
(45) Date of Patent: Jun. 21, 2016

(54) METHOD AND ARRANGEMENT

(75) Inventors: Johannes Haarla, Tampere (FI); Sakari Paunila, Sarkola (FI); Markku Rislakki, Tampere (FI); Jouko Niinimäki, Oulu (FI); Mika Körkkö, Oulu (FI); Terhi Suopajärvi, Oulu (FI)

(73) Assignee: Haarla OY, Tampere (FI)

( * ) Notice: Subject to any disclaimer, the term of this patent is extended or adjusted under 35 U.S.C. 154(b) by 477 days.

(21) Appl. No.: 13/807,361

(22) PCT Filed: Jul. 1, 2011

(86) PCT No.: PCT/FI2011/050624
§ 371 (c)(1),
(2), (4) Date: Mar. 13, 2013

(87) PCT Pub. No.: WO2012/001239
PCT Pub. Date: Jan. 5, 2012

(65) Prior Publication Data

US 2013/0206877 A1 Aug. 15, 2013

(30) Foreign Application Priority Data

Jul. 2, 2010 (FI) ..... 20105760

(51) Int. Cl.

| | |
|---|---|
| ***B02C 21/00*** | (2006.01) |
| ***D21D 1/00*** | (2006.01) |
| ***D21D 5/02*** | (2006.01) |
| ***D21F 1/70*** | (2006.01) |

(52) U.S. Cl.
CPC ..... *B02C 21/00* (2013.01); *D21D 1/004* (2013.01); *D21D 1/006* (2013.01); *D21D 5/02* (2013.01); *D21F 1/70* (2013.01)

(58) Field of Classification Search
CPC ..... B02C 21/00; D21C 5/02; D21B 1/32
USPC ..... 241/19, 47
See application file for complete search history.

(56) References Cited

U.S. PATENT DOCUMENTS

| | | | |
|---|---|---|---|
| 3,744,763 | A | 7/1973 | Schnoring et al. |
| 3,996,012 | A | 12/1976 | Zucker |
| 4,414,330 | A | 11/1983 | Zucker et al. |

(Continued)

FOREIGN PATENT DOCUMENTS

| | | | |
|---|---|---|---|
| DE | 102 44 521 | B3 | 2/2004 |
| DE | 10256519 | A1 | 6/2004 |

(Continued)

OTHER PUBLICATIONS

Office Action dated Mar. 3, 2015 for EP Application No. 11 172 322.7-1710.

(Continued)

*Primary Examiner* — Mark Rosenbaum
(74) *Attorney, Agent, or Firm* — Ladas & Parry LLP

(57) ABSTRACT

A method and an arrangement for treating stock formed of recycled fiber. The method comprises treating the stock in screen means and a flotation cell means, and screening the stock into accept and reject. Reject from the screening is directed to a mechanical dispergator and a dispersed reject is formed of it.

10 Claims, 10 Drawing Sheets

(56) References Cited

U.S. PATENT DOCUMENTS

| | | | |
|---|---|---|---|
| 6,883,737 | B2 | 4/2005 | Fisch et al. |
| 2003/0042344 | A1 | 3/2003 | Fisch et al. |
| 2006/0254732 | A1 | 11/2006 | Dockal-Baur et al. |

FOREIGN PATENT DOCUMENTS

| | | | |
|---|---|---|---|
| DE | 102007017987 | A1 | 10/2008 |
| DE | 10 2008 009 134 | A1 | 8/2009 |
| EP | 1077281 | A1 | 2/2001 |
| EP | 1 798 331 | A1 | 6/2007 |
| EP | 1 889 971 | A1 | 2/2008 |
| FI | 105699 | | 10/1999 |
| JP | 2004-263323 | A | 4/2004 |
| JP | 2005-504903 | A | 2/2005 |
| JP | 2006-52486 | A | 2/2006 |
| JP | 2006-316400 | A | 11/2006 |

OTHER PUBLICATIONS

Espacenet English abstract of EP 1 889 971 A1.
Search Report dated Nov. 3, 2011 for Application No. EP 11172322.7.
Office Action dated May 26, 2015 for Japanese Application No. 2013-517423 with English translation.
Espacenet English abstract of JP 2006-316400 A.
Espacenet English abstract of JP 2006-52486 A.
Espacenet English abstract of JP 2005-504903 A.

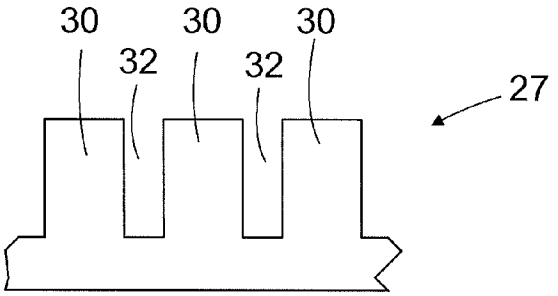
Fig. 11a
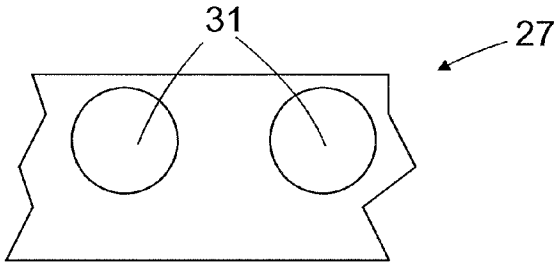
Fig. 11b
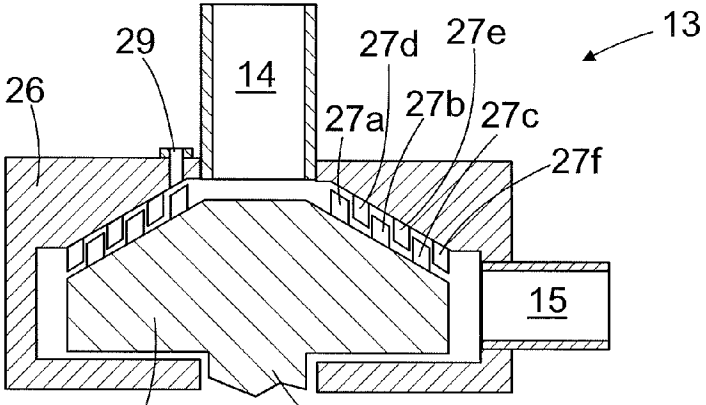
Fig. 9
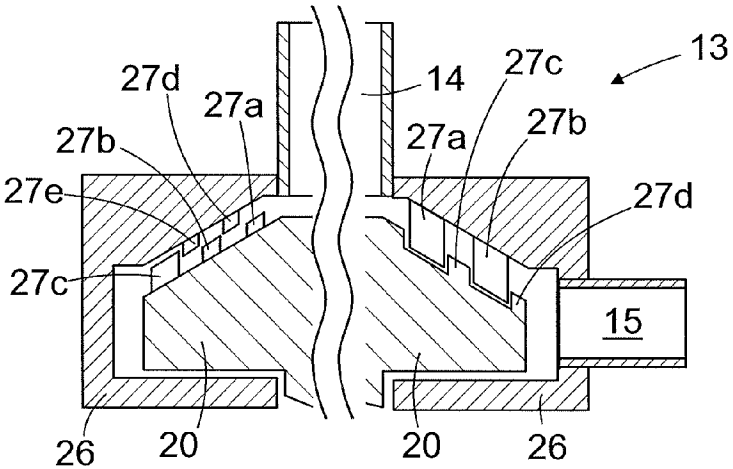
Fig. 10b
Fig. 10a

METHOD AND ARRANGEMENT

RELATED APPLICATION INFORMATION

This application is a 371 of International Application PCT/FI2011/050624 filed 1 Jul. 2011 entitled "Method and Arrangement", which was published in the English language on 5 Jan. 2012, with International Publication Number WO 2012/001239 A1, and which claims priority from Finnish Patent Application No. 20105760 filed on 2 Jul. 2010, the content of which is incorporated herein by reference.

BACKGROUND OF THE INVENTION

The invention relates to a method for treating stock formed of recycled fibre, the method comprising: treating the stock in screen means and a flotation cell means, and screening the stock into accept and reject.

Further, the invention relates to an arrangement for treating stock formed of recycled fibre, the arrangement comprising: a screen member preceding flotation, comprising means for screening the stock into accept of the preceding screening and reject of the preceding screening, which screen member preceding the flotation further comprises a discharge channel for the accept of the preceding screening and a discharge channel for the reject of the preceding screening; a flotation cell means with a feed channel for receiving the accept of the preceding screening as well as a discharge channel for the flotation accept and a discharge channel for the flotation reject; a fine screen member connected to said discharge channel for the flotation accept, which fine screen member comprises means for dividing the flotation accept into fine screen accept and fine screen reject and which fine screen member further comprises a discharge channel for the fine screen accept and a discharge channel for the fine screen reject.

Fibre stock made of recycled fibre, such as wastepaper, hereinafter referred to as 'stock', must be screened during the deinking process so that the stickies and dirt specks in the pulp will not disturb further treatment of the stock, for instance formation of a paper web.

It is known to take the pulp fraction removed along with the screen reject to waste disposal, i.e. either to incineration or to a dumping area.

A problem with the above arrangement is that said removed pulp fraction contains not only undesired material but also a large amount of good fibre which could be exploited. According to the present practice, this good fibre is wasted.

BRIEF DESCRIPTION OF THE INVENTION

An object of the invention is thus to provide a method and an arrangement so as to at least alleviate the above problem.

The objects of the invention are achieved by a method and system which are characterized by what is disclosed in the independent claims. Preferred embodiments of the invention are disclosed in the dependent claims.

The invention is based on treating reject generated in screening of deinking pulp with a mechanical dispergator, after which the reject treated with the dispergator can be directed to the flotation step, i.e. to the feed in the flotation step to be floated, or to a special flotation cell means of the dispergator. Mechanical treatment of the reject in a dispergator reduces what are called macro stickies in the pulp and creates, at the same time, some new, clean surface for them.

The same applies to the dirt specks in the reject. Thus, it becomes possible to remove them selectively in the flotation step.

An advantage of the method and arrangement according to the invention is that fibre material in the reject can be recovered and exploited.

The idea of a preferred embodiment of the invention comprises floating the stock in a flotation cell means and screening it into flotation accept and flotation reject; fine-screening the flotation accept into fine screen accept and fine screen reject; directing the fine screen reject to a mechanical dispergator, and forming a dispersed fine screen reject of it; and directing the dispersed fine screen reject back to said flotation cell means.

An advantage is that the amount of fibre material removed along with the fine screen reject is reduced.

The idea of a second preferred embodiment comprises screening the stock in the screening preceding flotation into accept of the preceding screening and reject of the preceding screening; directing the accept of the preceding screening to be floated in a flotation cell means; directing the reject of the preceding screening to a mechanical dispergator and forming dispersed reject of the preceding screening of it; and directing the dispersed reject of the preceding screening to be floated in said flotation cell means.

An advantage is that the amount of fibre material removed along with the reject of the screening preceding flotation is reduced.

BRIEF DESCRIPTION OF THE FIGURES

The invention will now be described in greater detail by means of preferred embodiments and with reference to the accompanying drawings, in which:

FIG. 9 shows schematically a side view of a second mechanical dispergator included in an arrangement according to the invention;

FIGS. 10*a* and 10*b* show schematically side views of a third and a fourth mechanical dispergator included in an arrangement according to the invention;

FIGS. 11*a* and 11*b* show schematically side views of a detail of mechanical dispergators included in an arrangement according to the invention;

In the figures, the invention is shown simplified for the sake of clarity. Similar parts are marked with the same reference numerals in the figures.

DETAILED DESCRIPTION OF THE INVENTION

Figure 1:
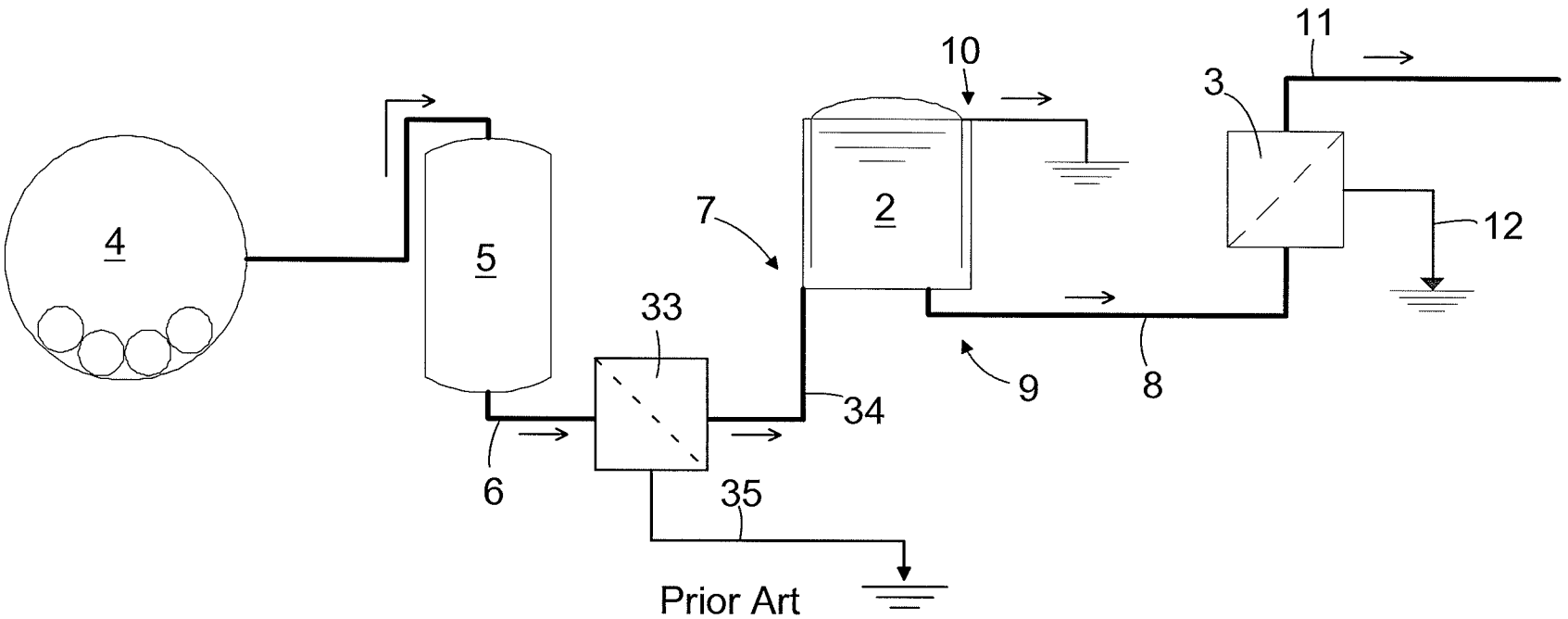
Prior Art Fig. 1
FIG. 1 shows schematically a known arrangement included in screening stock formed of recycled fibre.

FIG. 1 shows schematically a known arrangement included in screening stock formed of recycled fibre.

The basic elements of the arrangement are a flotation cell means 2, a screen member 33 preceding flotation, and a fine screen member 3. The material serving as the raw material of the stock, such as wastepaper, is fiberized, i.e. pulped, in a pulper 4. The stock is directed from the pulper 4 into a storage tower 5 or the like. Stock is dosed from the storage tower through a feed pipe system 6 into a screen member 33 preceding flotation.

The screen member 33 preceding the flotation comprises means for screening the stock into accept of the preceding screening and reject of the preceding screening. This screening is based at least primarily on the size and shape of the particles. The accepted stock, which may be referred to as the accept of the preceding screening, is directed through a channel 34 into a feed channel 7 of the flotation cell means 2 and to be floated in the flotation cell means. The reject of the preceding screening is directed out of the process through a channel 35.

In the flotation cell means 2, air is blown into the weak accept of the preceding screening, whereby air bubbles are generated in it. In the flotation cell means 2, chemicals enhancing flotation may also be added. Particles with a specific kind of surface chemistry adhere to the air bubbles and rise to the surface. The foam having risen to the surface is removed along with the particles adhered to it out of the process through a discharge channel for the flotation reject. The rest of the stock is directed through a discharge channel 9 for the flotation accept into a channel 8 for the flotation accept and further to the fine screen member 3.

The fine screen member 3 comprises means for screening the flotation accept into fine screen accept and fine screen reject. The fine screen accept is directed through a channel 11 for the fine screen accept to the use, for example directly to a paper machine. The screen reject is directed out of the process through a channel 12 for the fine screen reject.

Fine screen reject may be generated in the amount of approximately 10 liters per second, and the amount of fibre in it may be in the range of 0.1 kg/s. This means that more than 3 000 tons of fibre flow per year is wasted in papermaking.

Figure 2:
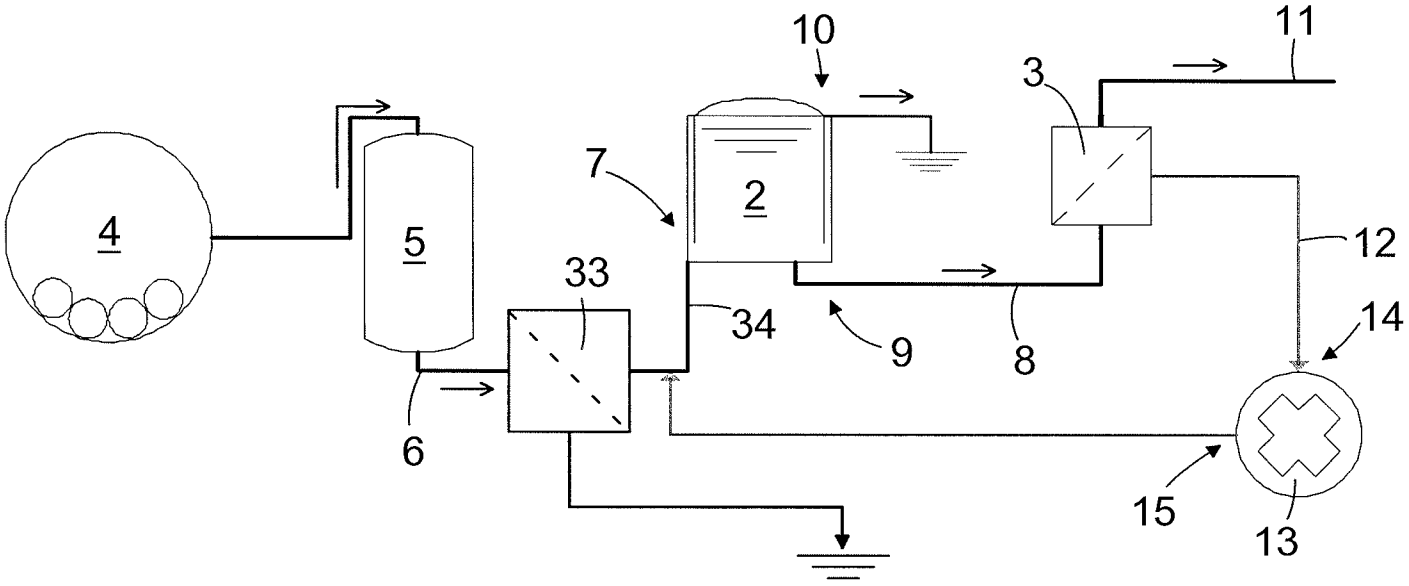
FIG. 2 shows schematically an apparatus used for making stock formed of recycled fibre, provided with an arrangement according to the invention.

FIG. 2 shows schematically an apparatus used for making deinking pulp, provided with an arrangement according to the invention. Deinking pulp refers to stock formed of recycled fibre.

The apparatus is similar to the one shown in FIG. 1, except that the arrangement according to the invention additionally includes a mechanical dispergator 13 and channels connected to it. A feed channel 14 of the mechanical dispergator 13 is connected to the discharge channel 12 for the reject of the fine screen member 3, so that the mechanical dispergator 13 receives fine screen reject. The mechanical dispergator 13 may receive all of the fine screen reject, i.e. 100%, or a part of it. In the latter alternative, the rest of the reject is directed past the mechanical dispergator 13, for instance out of the process.

The material to be removed from the mechanical dispergator 13 is fed to a return channel 15. The return channel 15 is connected to the feed channel 7 of the flotation cell means 2 in such a way that the dispersed fine screen reject generated in the mechanical dispergator 13 is fed back to the flotation cell means 2. In the embodiment shown in FIG. 2, the return channel 15 is connected to the channel 34. The return channel 15 may also be connected to the flotation cell means 2 via a separate conduit or the like.

In the embodiment of FIG. 2, the fine screen reject is treated with one mechanical dispergator 13. Instead of one mechanical dispergator 13, two or even more mechanical dispergators 13 may be used which are connected in parallel and/or in series.

Some mechanical dispergators 13 usable in embodiments of the invention are described in more detail in the context of FIGS. 8*a* to 10*b*. Still, it could be mentioned in this context that the mechanical dispergator 13 directs very intensive pressure pulses and possibly cavitation at the pulp. This reduces the micro stickies in the pulp and/or creates or reveals some new surface for them. In the same way, the dirt specks in the pulp become smaller and/or obtain some new surface. The new surface reacts easily in the flotation cell means 2.

The flotation cell means 2 comprises one or more flotation cells known as such connected in parallel and/or in series.

Both the preceding screen member 33 and the fine screen member 3 comprise one or more screens which most typically form a screen line which may comprise screens of various types, such as protective screens, vortex screens, reject defibrators, pressure screens and reject screens. These may be implemented with solutions known as such and are thus not explained in more detail in this context.

Figure 3:
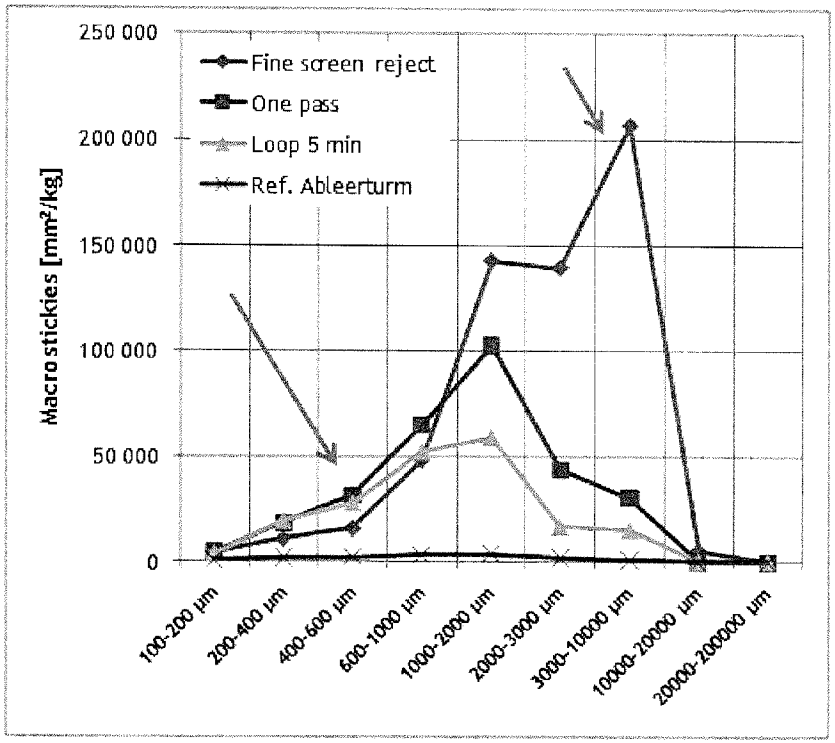
FIG. 3 shows schematically the effect of a mechanical dispergator on the occurrence and size distribution of macro stickies.

FIG. 3 shows schematically the effect of a mechanical dispergator on the occurrence and size distribution of macro stickies in stock. This mechanical dispergator was, with regard to its principle, according to FIGS. 9 and 10*a*, having the trade name Cavitron 1000, and it was connected in accordance with FIG. 2. The volume flows presented here are derived and based on process flows in an example factory. The volume flow was 1 030 l/s in the channel 34; 927 l/s in the channel 8 for the flotation accept; and 9.5 l/s in the channel 12 for the fine screen reject. The consistency of the stock was 1.5% in the channel 34; 1.4% in the channel 8 for the flotation accept; and 1.2% in the channel 12 for the fine screen reject.

It is seen that when the fine screen reject is treated in the mechanical dispergator 13, the number of macro stickies in the size range of 2 000 to 10 000 μm in the pulp (One pass) drops very substantially. The macro stickies in the above-mentioned size range are disintegrated into smaller macro stickies in the size range of about 200-1 000 μm. Along with the disintegration, some new, clean surface which is capable of reacting is formed for the macro stickies.

It was also studied how recycling the fine screen reject in the dispergator for a longer period affects the result. The reject was recycled for five minutes (Loop 5 min) through the mechanical dispergator 13. It can be seen that particularly macro stickies in the size range of 600 to 10 000 μm can be reduced even more.

Figure 4:
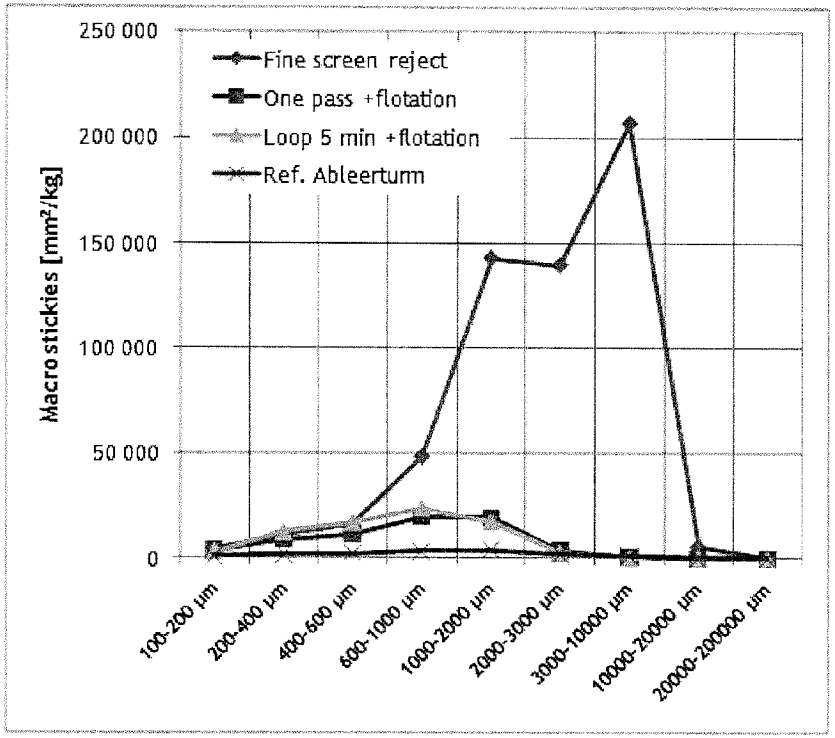
FIG. 4 shows schematically a change in the macro stickies in stock, achieved with the arrangement and method according to the invention.

FIG. 4 shows schematically a change in the macro stickies in stock, achieved with an arrangement and a method according to the invention.

The above-mentioned mechanical dispergator 13 and variable values were used. The dispersed fine screen reject was fed from the mechanical dispergator 13 to the flotation cell means 2, and the size distribution of the macro stickies shown in FIG. 4 was measured from the flotation cell accept. It can be seen that the majority of macro stickies have been successfully removed from the pulp. An extremely good result is obtained by a combination of the mechanical dispergator 13 and the flotation cell means 2. It can also be seen that the result obtained with pulp passed once through the dispergator 13 (One pass+flotation) is, in practice, the same as with pulp recycled for five minutes (Loop 5 min+flotation).

Figure 5:
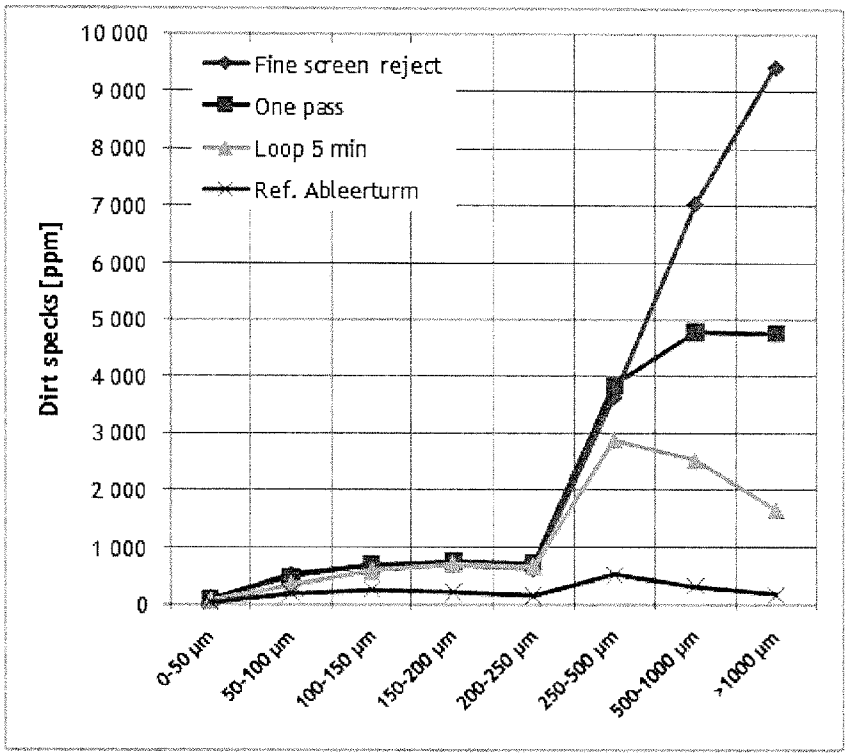
FIG. 5 shows schematically the effect of a mechanical dispergator on the occurrence and size distribution of dirt specks.

FIG. 5 shows schematically the effect of a mechanical dispergator on the occurrence and size distribution of dirt specks. The above-mentioned mechanical dispergator 13 and variable values were used.

The dirt specks of the pulp flowing in the fine screen reject channel 12 were primarily (89%) of a size of >250 μm. When said pulp had been treated with the mechanical dispergator 13, the number of largest dirt specks of over 500 μm had been dropped to about half. Large dirt specks could be reduced even more efficiently by recycling pulp with the mechanical dispergator for five minutes.

Figure 6:
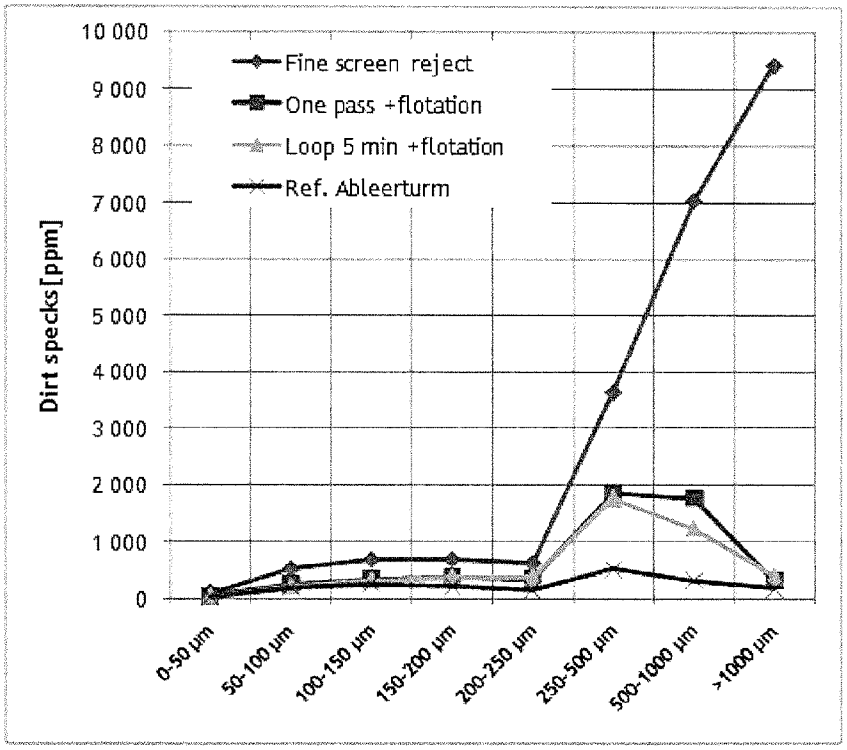
FIG. 6 shows schematically a change in the occurrence and size distribution of the dirt specks in stock, achieved with the arrangement and method according to the invention.

FIG. 6 shows schematically a change in the occurrence and size distribution of the dirt specks, achieved with an arrangement and a method according to the invention. The dispersed fine screen reject treated in accordance with the description of FIG. 5 was fed back to the flotation cell 2. It can be seen that the number of dirt specks of all sizes could be reduced and that the result of the mechanical pulp passed once through the mechanical dispergator 13 is, in practice, the same as that of the pulp recycled for five minutes. Larger dirt specks still in the pulp are visible even after the flotation, but they are still in such a size range that in fine screening they end up in fine screen reject and thus in retreatment by the mechanical dispergator 13. Therefore, it is highly probable that these large dirt specks will not end up in the paper machine with the fine screen accept.

Figure 7:
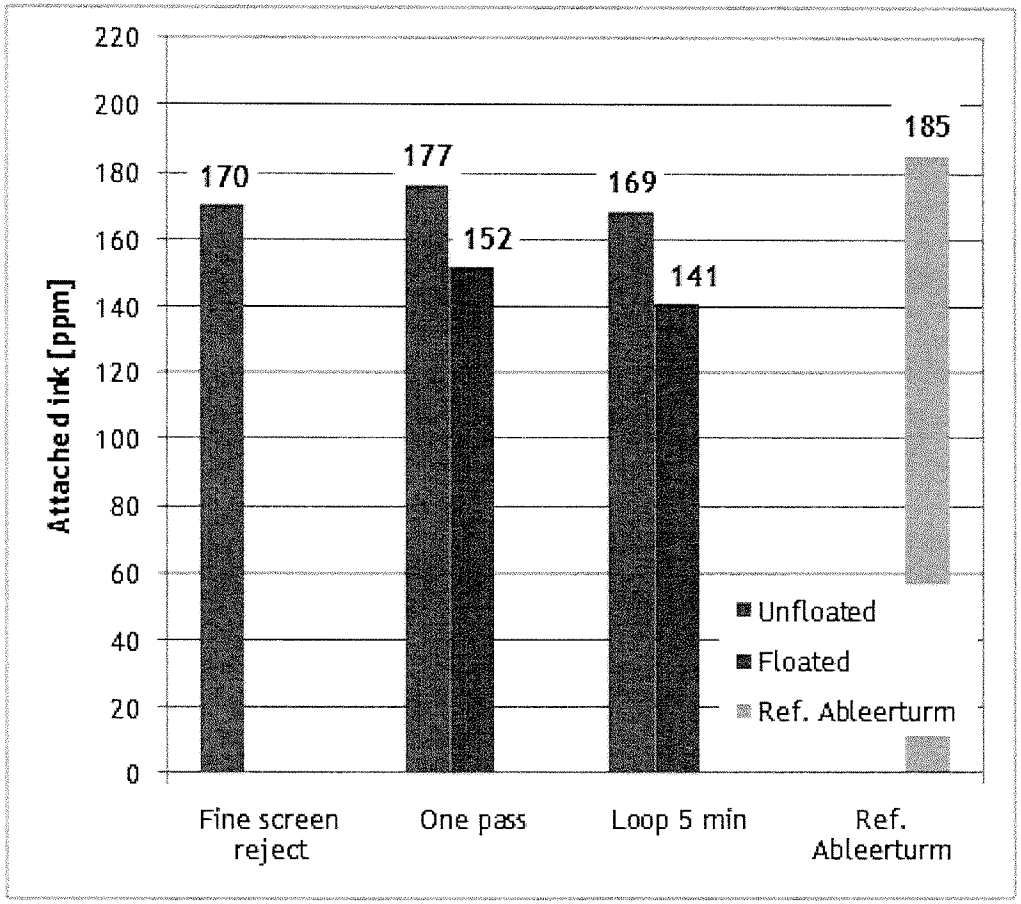
FIG. 7 shows schematically a change in the amount of adhered printing ink in stock, achieved with the arrangement and method according to the invention.

FIG. 7 shows schematically a change in the amount of adhered printing ink in stock, achieved with an arrangement and a method according to the invention. It can be seen that flotation combined with treatment with the mechanical dispergator 13 reduces the amount of printing ink adhered to the stock, compared with stock fed from the storage tower 5 (Ableerturm).

Figure 8B:
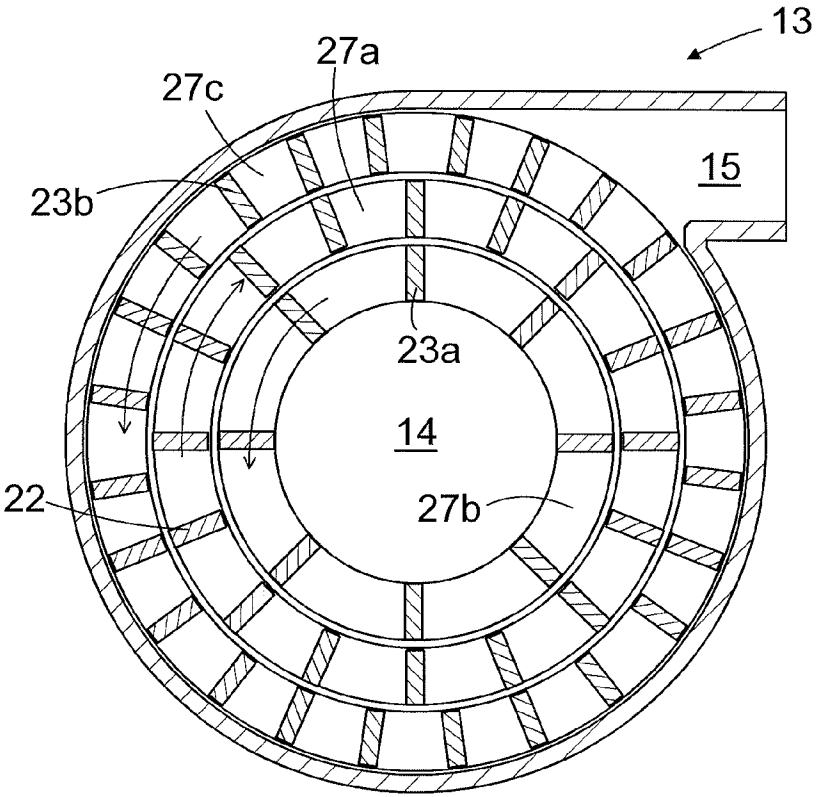
FIGS. 8*a* and 8*b* show schematically side and top views of a mechanical dispergator included in an arrangement according to the invention in partial cross-section.
Figure 8A:
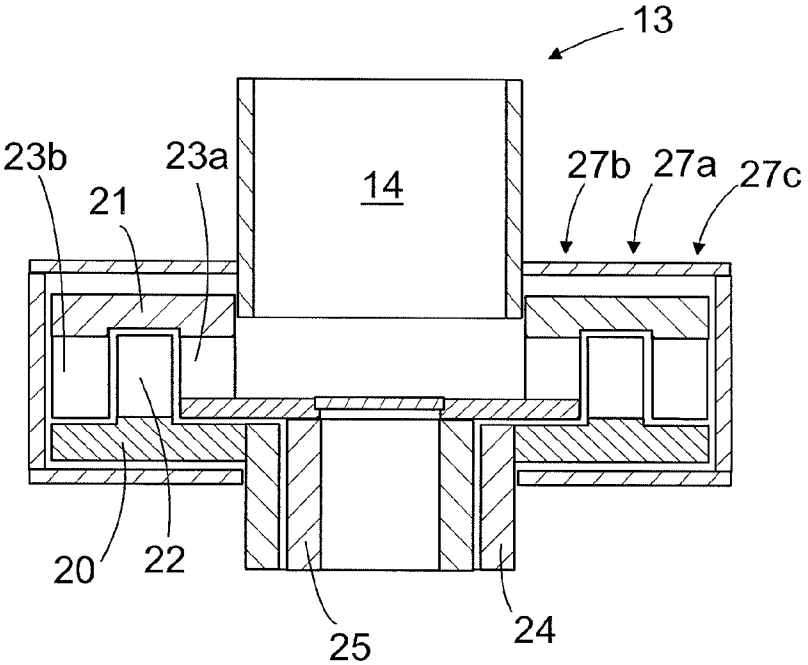

FIGS. 8*a* and 8*b* show schematically side and top views of a mechanical dispergator included in the arrangement according to the invention in partial cross-section.

The mechanical dispergator 13 comprises a rotating first rotor 20 and a second rotor 21 rotating relative to the first rotor and being concentric with it. The rotors 20, 21 are connected to rotate in opposite directions. The first rotor 20 is provided with first blades 22 on one blade circle. This blade circle forms a first surface with openings 27*a*, because there is an opening between two adjacent first blades 22.

The second rotor 21 is provided with second blades 23*a*, 23*b* on two blade circles on both sides of the blade circle formed by the first blades 22. These blade circles form a second and a third surface with openings 27*b*, 27*c*.

Said surfaces 27*a* to 27*c* with openings are intermeshed and concentric with each other.

It is to be noted that the number of blade circles, the number of blades in them, the shape and dimensions of the blades and the like properties may differ from the mechanical dispergator 13 shown in FIGS. 8*a*, 8*b*.

The first rotor 20 and the first blades 22 arranged in them are rotated via a first drive shaft 24, the second rotor 21 with its second blades 23*a*, 23*b* being rotated with a second drive shaft 25.

The feed opening 14 of the mechanical dispergator is arranged at the centre of the rotors. The pulp fed here passes through the surfaces with openings, i.e. from between the blades 22, 23*a*, 23*b* in the direction of the outer circle and further out through the return channel 15. The pulp is subjected to intensive shear forces and possibly cavitation in such a way that the macro stickies, dirt specks and/or adhered colour agent contained by the pulp are detached from the fibres, split and/or disintegrate.

FIG. 9 shows schematically a side view of a mechanical dispergator included in the arrangement according to the invention. The mechanical dispergator 13 comprises now a stator 26 and a first rotor 20 rotating relative to it. The stator 26 is provided with three concentric and circular surfaces 27*a*, 27*b*, 27*c* with openings. Also the rotor 20 is provided with three concentric and circular surfaces 27*d*, 27*e*, 27*f* with openings, the surfaces being intermeshed with the stator surfaces with openings and concentric relative to them.

The surfaces 27*a* to 27*f* with openings in both the stator 26 and the rotor 20 may comprise teeth 30 according to FIG. 11*a* between which there is an opening 32, or holes 31 according to FIG. 11*b*, or both. It may be that all surfaces with openings in the mechanical dispergator 13 have a tooth—opening structure or only holes, or alternatively some surfaces with openings may have a tooth—opening structure while some have holes. The opening 32 is typically at least substantially as high as the surface with openings.

In the embodiment shown in FIG. 9, the cross-sections of all surfaces 27*a* to 27*f* with openings are substantially of the same shape and size, but this is by no means necessary.

The mechanical dispergator comprises a feed opening 29, through which additive may be fed to the screen reject. The additive may be, for example, dispersing agent, surface-active agent or steam. Steam may be used for raising the temperature of the process, for instance. It is to be noted that also the mechanical dispergator 13 comprising two rotors according to FIG. 8*a* may have a feed opening 29.

FIGS. 10*a*, 10*b* show schematically a side view of a second and a third mechanical dispergator included in the arrangement according to the invention.

The second mechanical dispergator is shown on the left in FIG. 10*a*, and the third one on the right in FIG. 10*b*.

The mechanical dispergator 13 shown in FIG. 10*a* resembles the one shown in FIG. 9 but differs from it in that the outermost surface 27*c* with openings in the rotor 20 is substantially wider and longer than the other surfaces 27*a*, 27*b*, 27*d*, 27*e* with openings. A further difference is that said other surfaces 27*a*, 27*b*, 27*d*, 27*e* with openings are not intermeshed relative to each other.

The mechanical dispergator 13 shown in FIG. 10*b* clearly shows the fact that the surfaces with openings may most preferably be formed in the stator 26 and/or rotor 20 by making circular grooves in them, the required openings being made in the ridges between the grooves.

Mechanical screens 13 are available for instance under trade names Cavitron®, Supraton®, Atrex®. Some mechanical screens 13 are shown in patent publications U.S. Pat. No. 3,744,763, U.S. Pat. No. 3,996,012, U.S. Pat. No. 4,414,330, U.S. Pat. No. 6,883,737 and F1105699, for example.

Figure 12:
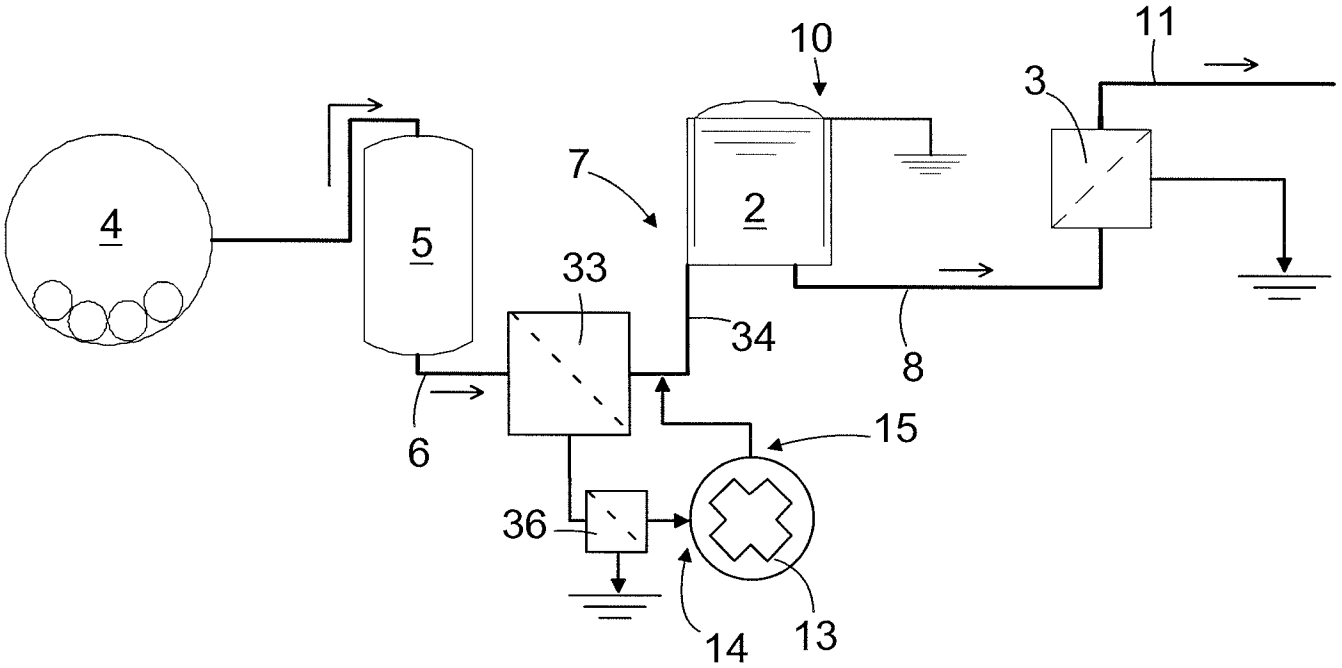
FIG. 12 shows schematically an apparatus used for making stock formed of recycled fibre, provided with a second arrangement according to the invention.

FIG. 12 shows schematically an apparatus used for making stock formed of recycled fibre, provided with a second arrangement according to the invention.

The feed channel 14 of the mechanical dispergator 13 is connected to receive reject of the screening member 33 preceding flotation from the channel 35. The mechanical dispergator 13 may receive all of said reject, i.e. 100%, or a part of it. In the latter alternative, the rest of the reject is directed past the mechanical dispergator 13, for instance out of the process.

The return channel 15 of the mechanical dispergator is connected to the inlet side of the flotation cell means 2 in such a way that the reject of the preceding screening, having been treated in the mechanical dispergator 13, can be fed to be floated in the flotation cell means 2.

A protective screen 36 is connected to the channel 35 for the purpose of screening from the arriving reject such material which could damage the mechanical dispergator 13 or cause it to get clogged. It is to be noted, however, that the arrangement may also be implemented without a protective screen 35.

Figure 13:
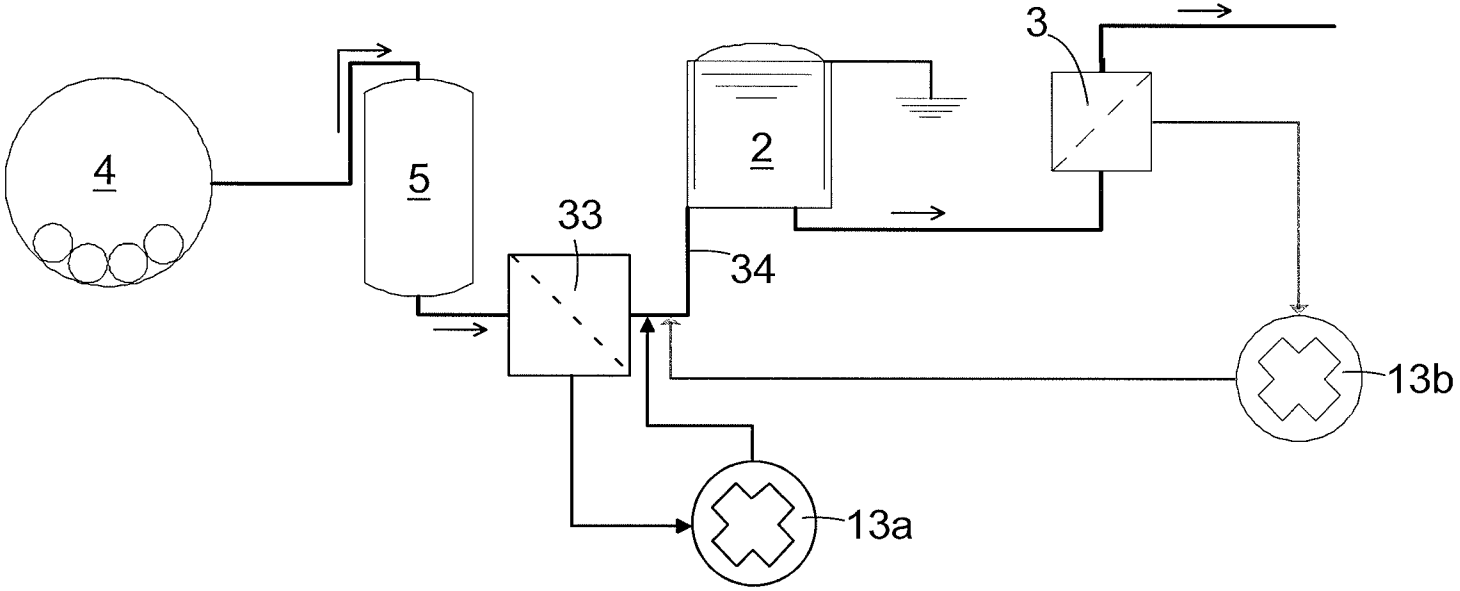
FIG. 13 shows schematically an apparatus used for making stock formed of recycled fibre, provided with a third arrangement according to the invention.

FIG. 13 shows schematically an apparatus used for making stock formed of recycled fibre, provided with a third arrangement according to the invention. Said arrangement is a combination of the arrangements shown in FIGS. 2 and 12. In other words, it comprises treatment of both the reject of the preceding screening and the fine screen reject with mechanical dispergators 13*a*, 13*b*.

Figure 14:
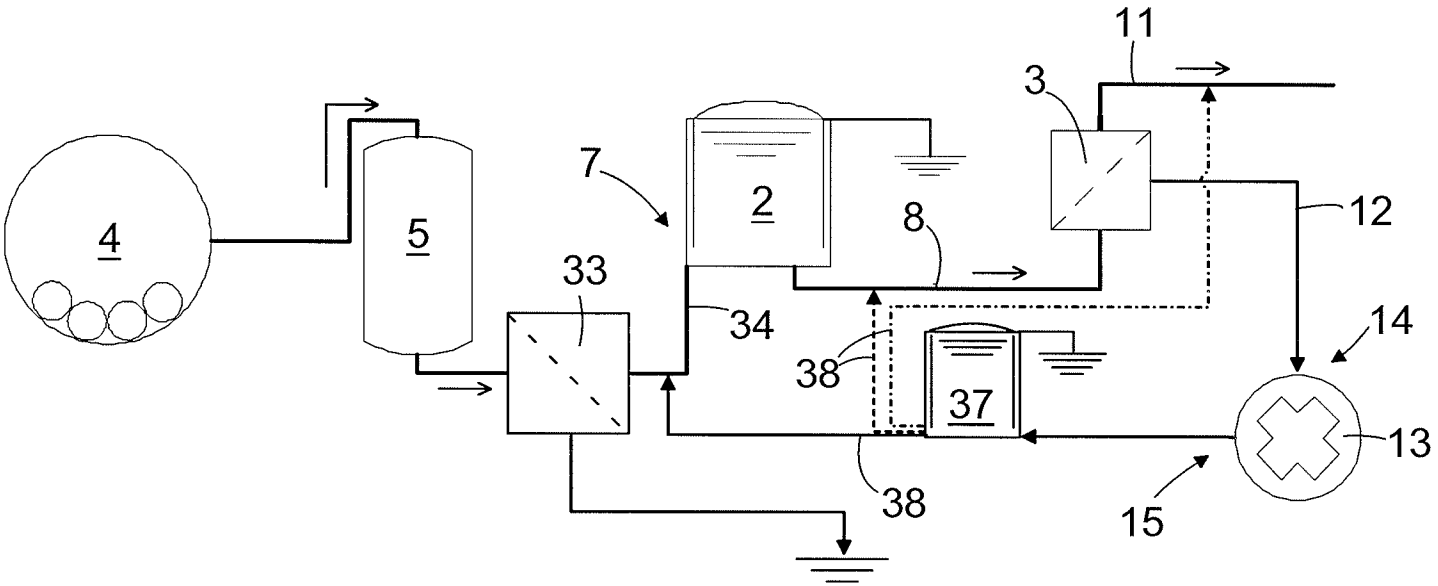
FIG. 14 shows schematically an apparatus used for making stock formed of recycled fibre, provided with a fourth arrangement according to the invention.

FIG. 14 shows schematically an apparatus used for making stock formed of recycled fibre, provided with a fourth arrangement according to the invention. FIG. 14 further shows three alternatives for connecting the arrangement to the apparatus.

The arrangement comprises a flotation cell means 37 of the dispergator, which operates in the manner corresponding as such to the above-described flotation cell means 2. The return channel 15 of the mechanical dispergator is connected to feed dispersed fine screen reject to the flotation cell means 37 of the dispergator. The accept from the flotation cell means 37 of the dispergator is fed through an accept channel 38 thereof to the flotation cell means 2.

The broken line shows a second alternative of the connection of the flotation cell means 37 of the dispergator. Here, the accept from the flotation cell means 37 of the dispergator is fed to the feed of the fine screen member 3, for example to the flotation accept channel 8.

The dot-and-dash line shows a third alternative of the connection of the flotation cell means 37 of the dispergator. Here, the accept from the flotation cell means 37 of the dispergator is fed into the accept of the fine screen member 3, for example to the fine screen accept channel 11.

The embodiment shown in FIG. 14 may be combined with an embodiment of an arrangement already explained earlier, such as with the arrangement shown in FIG. 12.

It will be obvious to one skilled in the art that as technology advances, the basic idea of the invention may be implemented in many different ways. The invention and its embodiments are thus not restricted to the examples described above but may vary within the scope of the claims.

The invention claimed is:

1. Method for treating stock obtained by pulping fibre-containing raw material to release recycled fibre and removing contaminants therefrom, the method comprising:

treating the stock in at least one screen means and a floatation cell means, and screening stock into accept and reject, directing the screen reject to a mechanical dispergator and forming a dispersed reject of it, and directing the dispersed reject back to the floatation cell means or to a floatation cell means of the dispergator and combining the product from said floatation cell means of the dispergator with an accept of screen means or floatation cell means.

2. A method according to claim 1, comprising floating the stock in the flotation cell means and screening it into flotation accept and flotation reject;

fine-screening the flotation accept into fine screen accept and fine screen reject;

directing the fine screen reject to the mechanical dispergator and forming a dispersed fine screen reject of it; and directing the dispersed fine screen reject back to said flotation cell means.

3. A method according to claim 2, further comprising screening the stock in screening preceding floatation into accept of the preceding screening and reject of the preceding screening;

directing the accept of the preceding screening to be floated in the flotation cell means;

directing the reject of the preceding screening to the mechanical dispergator and forming a dispersed reject of the preceding screening of it; and directing the dispersed reject of the preceding screening to be floated in said floatation cell means.

4. A method according to claim 1 further comprising screening the stock in screening preceding flotation into accept of the preceding screening and reject of the preceding screening;

directing the accept of the preceding screening to be floated in the flotation cell means;

directing the reject of the preceding screening to the mechanical dispergator and forming a dispersed reject of the preceding screening of it; and directing the dispersed reject of the preceding screening to be floated in said flotation cell means.

5. A method according to claim 1 further comprising directing the dispersed reject to the flotation cell means of the dispergator; and directing the accept of the flotation cell means of the dispergator to the flotation cell means.

6. A method according to claim 1 further comprising directing the dispersed reject to the floatation cell means of the dispergator; and directing the accept of the floatation cell means of the dispergator into the floatation accept.

7. A method according to claim 1 further comprising feeding additive to the reject.

8. A method according to claim 7, further comprising feeding the additive to the mechanical dispergator.

9. A method according to claim 7 wherein the additive is steam.

10. A method according to claim 1, further comprising directing the dispersed reject to the floatation cell means of the dispergator; and directing the accept of the floatation cell means of the dispergator into the fine screen accept.

* * * * *